United States Patent [19]

Höppel et al.

[11] 4,387,695

[45] Jun. 14, 1983

[54] FUEL INJECTION APPARATUS

[75] Inventors: Rainer Höppel, Stuttgart; Heinrich Knapp, Leonberg, both of Fed. Rep. of Germany

[73] Assignee: Robert Bosch GmbH, Stuttgart, Fed. Rep. of Germany

[21] Appl. No.: 294,125

[22] Filed: Aug. 19, 1981

[30] Foreign Application Priority Data

Sep. 6, 1980 [DE] Fed. Rep. of Germany ..... 3033644

[51] Int. Cl.[3] ..... F02B 3/00; F02M 23/04

[52] U.S. Cl. ..... 123/585; 123/586; 123/587; 123/531; 123/472

[58] Field of Search ..... 123/531, 472, 585

[56] References Cited

U.S. PATENT DOCUMENTS

| | | | |
|---|---|---|---|
| 3,020,905 | 2/1962 | Goschel | 123/472 |
| 3,882,828 | 5/1975 | Honiden | 123/531 |
| 4,046,121 | 9/1977 | Pierlot | 123/531 |
| 4,206,599 | 6/1980 | Sumiyoshi | 123/531 |

*Primary Examiner*—Ronald B. Cox
*Attorney, Agent, or Firm*—Edwin E. Greigg

[57] ABSTRACT

A fuel injection apparatus for externally ignited internal combustion gas engines is proposed. The fuel injection apparatus comprises an intake pipe in which an air flow meter and a throttle valve are provided. The fuel quantity injected into the intake pipe via an injection valve is controlled by the air flow meter. To prepare the combustible mixture of injected fuel and air, a preparation air line branches off from the intake pipe between the air flow meter and the throttle valve. This preparation air line discharges into the injection valve. A throttle is provided in the preparation air line. A full-load air line discharges into the preparation air line between the throttle and injection valve. A shut-off valve is provided in the full-load air line, said shut-off valve being completely open at least during the full-load operation of the combustion engine, allowing additional air flow into the preparation air line, which air is drawn from the intake pipe upstream of the air flow meter.

2 Claims, 2 Drawing Figures

FUEL INJECTION APPARATUS

BACKGROUND OF THE INVENTION

The invention is directed to a fuel injection apparatus in which air is provided to the fuel in the injection valve to prepare the fuel for mixturing in the air intake tube downstream of the injection valve. A fuel injection apparatus is already known in which preparation air is fed to the fuel to be injected immediately before its injection into the intake pipe. However, the known device has the disadvantage that during idling, too great a quantity of preparation air is fed into the injection valve so that high idling rpms result. An overall reduction of the air supplied to the injection valve would enable a lowering of the idling rpm but would also cause a deterioration of the full-load operation fuel transport.

OBJECT AND SUMMARY OF THE INVENTION

It is an object of the invention to provide a fuel injection apparatus having the advantage that the preparation air quantity is controllable dependent upon the operational state of the internal combustion engine. (i.e., idle to full load).

It is a further object of the invention to supply a larger preparation air quantity to the injection valve under a full-load state of the internal combustion engine than in the idling or partial load states.

The invention will be better understood and further objects thereof will become more apparent from the ensuing detailed description of a preferred exemplary embodiment taken in conjunction with the drawings.

DESCRIPTION OF THE PREFERRED EMBODIMENTS

Figure 1:
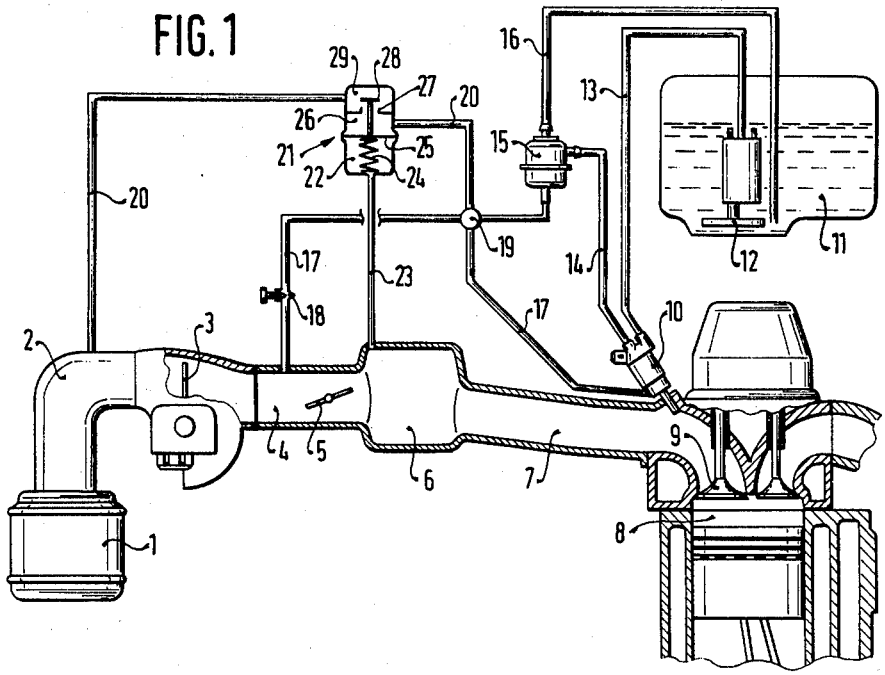
FIG. 1 shows schematically a fuel injection pump according to the invention.

FIG. 1 shows a fuel injection apparatus for externally ignited internal gas combustion engines having an air filter 1 downstream of which is provided an intake pipe section 2 which is limited on the other side by an air flow meter 3. The air flow meter 3 can be provided as a flap valve which is deflected in a known fashion according to the air quantity flowing through the intake pipe counter to a restoring force, for example, a spring, whereby the position of the air flow meter 3 is measured, for example, by a potentiometer and, changed into an electric signal, is fed into an electrical control device (not shown). Downstream of the air flow meter 3 the intake air quantity arrives in a suction pipe section 4 in which is provided on the other side a throttle member comprising a throttle valve 5, to which section a further intake plenum 6 connects downstream of the throttle valve 5, from which plenum individual intake pipes 7 lead to the individual cylinders 8, of which only one is shown, of an externally-ignited internal combustion engine. The inlet into the cylinder 8 is controlled by an inlet valve 9, into the immediate vicinity of which fuel can be injected, for example, via an electromagnetically-actuable injection valve 10. The electromagnetically-actuable injection valve 10 can be controlled in a known fashion by an electronic control device dependently upon operational characteristics of the internal combustion engine, such as intake air quantity, temperature, exhaust gas composition, and the like.

The supply of the injection valve 10 with fuel takes place, for example, via a fuel pump 12 arranged in a fuel tank 11. The fuel pump 12 feeds fuel to the injection valves 10 via a fuel supply line 13, such that a portion of the fuel feed is injected via the injection valves 10. The remaining portion of the fuel flowing through the injection valves is fed to a control line 14 in which is provided a pressure control valve 15 through which valve the fuel pressure upstream of the pressure control valve 15 is regulated and via which valve can flow back from the control line 14 into a return line 16 and thus can flow back into the fuel tank 11.

Especially during injection of the fuel under low pressure (approximately 1 bar), it is advantageous for good mixture preparation for the fuel to be injected to undergo atomization with the aid of air. The atomization air can be guided to the injection valve 10 via a preparation air line 17 which branches off from the intake pipe section 4 upstream of the throttle valve 5 and discharges at the injection valve 10 as described in detail hereinafter in connection with FIG. 2. A throttle 18 is provided in the preparation air line 17, said throttle 18 being, for example, randomly adjustable. The preparation air necessary for the idling or partial load states of the internal combustion engine can be determined by the throttle 18 in such a manner that the lowest possible idling rpm of the internal combustion engine can be choosen without disadvantageous influencing the fuel-air mixture at rpms up to those of partial load. However, in order to avoid a disadvantageous influencing of the fuel-air mixture in the full-load region, a full-load air line 20 discharges into the preparation air line 17 between the throttle 18 and the injection valve 10 at a junction 19. This full-load air line 20 branches off from the intake pipe section 2 upstream of the air flow meter 3. The pressure control valve 15 can be connected to junction 19 as well, whereby the fuel pressure regulated by the pressure control valve 15 can be adjusted in accordance with intake pipe pressure. A shut-off valve 21 is arranged in the full-load air line 20 so as to communicate air from the full-load air line 20 into the preparation air line 17 only during a full-load state of the internal combustion engine in an advantageous manner. A shut-off valve 21, for example, includes a vacuum chamber 22 to which a vacuum line 23 is connected with the intake pipe section 6 downstream of the throttle valve and further includes a pressure spring 24 which supports a membrane 25 separating the vacuum chamber 22 from a first chamber 26 of the shut-off valve 21. The first chamber 26 is in turn connected to the junction 19 of the full-load air line 20. The first chamber 26 of the shut-off valve 21 is separated from a second chamber 29 by a valve seat 27 and a movable valve section 28. This second chamber 29 is connected with the vacuum pipe section 2 upstream of the air flow meter 3. The movable valve section 28 is rigidly connected with the membrane 25. The pressure of the spring 24 is choosen such that in the idling state and the partial load state of the internal combustion engine, the pressure prevailing in the vacuum chamber 22 via the vacuum line 23 is not sufficient, in connection with the pressure spring 24, to lift the movable valve section 28 from the valve seat 27, so that the full-load air line 20 is blocked by the shut-off valve 21. If the throttle valve 5 is moved, as shown, to the full-load position then the vacuum intake pipe pressure in section 6 rises so much that the pressure transmitted into the vacuum chamber 22 via the vacuum line 23 is sufficient in connection with the pressure spring 24 to open the shut-off valve 21. Thus, in the full-load state of the internal combustion engine a proportionately larger air quantity with a higher pressure is provided to the injection valve 10 via the full-load air line 20 than in the idling and partial load states.

Figure 2:
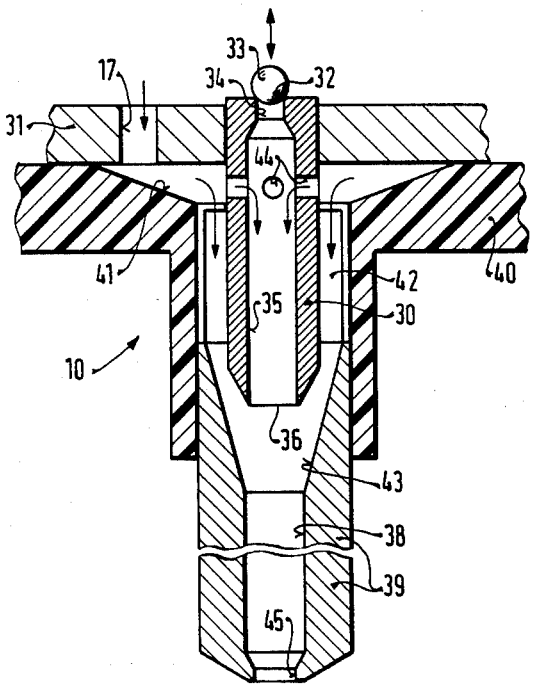
FIG. 2 shows a partial section of an injection valve provided with air preparation in accordance with the invention.

The injection valve 10 shown in partial section in FIG. 2 designates a valve body 30 which is inserted into a valve carrier 31 and which is provided with a fixed valve seat 32 formed for interaction with a movable valve seat 33 embodied, for example, as a ball. When movable valve section 33 is raised, fuel flows between the movable valve section and the valve seat 32 to a valve bore 34 in the valve body 30, which throttles the fuel allotment. From there the fuel flows into a fuel guidance channel 35 of enlarged diameter which leads to the outlet 36 of the valve body 30. The outlet 36 of the valve body 30 protrudes into a mixture guidance channel 38 in a mixture guidance member 39, which member is supported in a body 40 of synthetic material, especially designed for thermal insulation, which body 40 at least partially surrounds the fuel injection valve. A clearance 41 is provided in the body 40 for communication with the preparation air line 17 and further communication with an annular channel 42 which surrounds the section of the valve body 30 protruding out of the valve carrier 31. The annular channel 42 converges conically at 43 into the mixture guiding channel 38. It can be advantageous to supply secondary air to the fuel flowing through the fuel guide channel 35 immediately downstream of the valve bore 34 from the clearance 41 via small secondary air bores 44 or clearances. Thereby an initial mixing of air with the fuel to be injected takes place and furthermore assures that the fuel can flow out of the fuel guidance channel 35 into the mixture guidance channel 38 even at full load, in other words, under almost atmospheric pressure in the intake pipe. The fuel jet leaving the outlet 36 of the valve body 30 is immediately surrounded by the primary air flow in the conical area 43 of the annular channel 42 adjacent the mixture guidance channel 38 and the fuel transported into the mixture guidance channel 38 to the injection aperture 45 at the extremity of the mixture guidance channel 38 without wetting the wall and while simultaneously blending with air. The injection aperture 45 is formed such that the fuel is enveloped by air and can pass through into the intake pipe without clinging to the channel. A wall of air causes the fuel flow to achieve very high flow speeds in the mixture guidance channel because of low frictional resistance to the flow thus avoiding a wetting of the wall. It is appropriate to keep the diameter of the mixture guidance channel 38 as small as possible to achieve a venturi effect with high flow speeds in the mixture guidance channel. Preferably the diameter of the mixture guiding chamber is approximately three times as large as the diameter of the injection opening 45.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for mixture-compressing internal combustion engines with externally supplied ignition, said system having an intake tube in which a flow rate meter and an arbitrarily actuatable throttle device are disposed in sequence and the flow rate meter is moved counter to a restoring force in accordance with the quantity of air flowing therethrough further wherein said flow rate meter influences the quantity of the fuel to be injected at least through one injection valve into the intake tube, further wherein said system includes an air preparation line which branches off from said intake tube section between the flow rate meter and the throttle device and leads to the injection valve, said injection valve arranged to effect preparation of said fuel by means of the air delivered downstream of the valve seat of the injection valve, characterized in that said air preparation line includes a throttle restriction and further that a full-load air line is arranged to discharge into said air preparation line between said throttle restriction and said injection valve, further wherein said full-load air line branches off from said intake tube section upstream of said flow rate meter said last named line further including a blocking valve provided with a movable valve member which is controllable in accordance with the intake tube pressure downstream of said throttle device.

2. A fuel injection system as defined by claim 1, characterized in that said blocking valve in said full-load air line is controllable by said intake tube pressure downstream of said throttle device in such a manner that it is fully open at least at an intake tube pressure which characterizes the full-load range of the engine.

* * * * *